US005553519A

United States Patent [19]

Pettit, Jr.

[11] Patent Number: 5,553,519

[45] Date of Patent: Sep. 10, 1996

[54] FASTENER INSTALLATION TOOL

[76] Inventor: Jack E. Pettit, Jr., 2254 Conestoga Dr., Carson City, Nev. 89706

[21] Appl. No.: 451,183

[22] Filed: May 26, 1995

[51] Int. Cl.[6] ..... B25B 23/157

[52] U.S. Cl. ..... 81/56; 81/57.14; 81/475

[58] Field of Search ..... 81/55, 56, 57, 81/57.11, 57.14, 57.3, 429, 473, 475

[56] References Cited

U.S. PATENT DOCUMENTS 2,882,773 4/1959 Wing ..... 81/56
3,247,741 4/1966 Batten ..... 81/56
3,397,601 8/1968 Batten ..... 81/56
5,109,735 5/1992 Hart .

*Primary Examiner*—D. S. Meislin
*Attorney, Agent, or Firm*—Kelly Bauersfeld & Lowry

[57] ABSTRACT

An improved fastener installation tool is provided of the type having a fixture pin for seated reception into a mating recess at the shank end of a threaded fastener, while a power-driven socket installs a threaded nut onto the fastener shank. The installation tool includes a spring-loaded clutch assembly for supporting the fixture pin on the tool, wherein the clutch assembly permits fixture pin rotation in response to a torque load exceeding a predetermined limit to prevent fixture pin breakage in the event of a high torque load applied thereto.

12 Claims, 3 Drawing Sheets

FASTENER INSTALLATION TOOL

BACKGROUND OF THE INVENTION

This invention relates generally to improvements in power tools for use in the installation of threaded fasteners, particularly specialized threaded fasteners of the type used in the aerospace and related industries. More specifically, this invention relates to improvements in a fastener installation tool of the type having a power-driven socket for installing a threaded nut onto a threaded fastener, in combination with a fixture pin for engaging and retaining the threaded fastener against rotation during nut installation.

A variety of specialized fasteners have been developed and are widely used in the aerospace and related industries, wherein these threaded fasteners have been designed to meet specific design criteria and uses. One example of a specialized aerospace fastener comprises a threaded bolt adapted for power-driven installation of a threaded nut, without requiring access to the bolt head. That is, such fasteners are designed to fit through a preformed opening in a substrate or structure with the bolt head inaccessibly disposed at a blind side thereof. A bolt shank protrudes through the substrate opening with a threaded end exposed for screw-on installation of a threaded nut. The shank end is formed to include a small shallow recess of typically hexagonal shape for receiving a mating fixture pin designed to hold the bolt against rotation as the nut is installed. Power-driven installation tools are known for use installing such fasteners, including a small fixture pin disposed coaxially within a power-driven socket for installing the threaded nut while the fixture pin holds the bolt against rotation. One example of such power-driven installation tools is available from United Air Tool, Inc. of Carson City, Nev. under model designation 10185 Series "L" angle head.

In a typical fastener application, using a power-driven installation tool of the type described above, the fixture pin engages and supports the fastener shank, and progressively retracts within the power-driven socket as the threaded nut is advanced onto the fastener shank. At least some friction between the bolt and the substrate assists the fixture pin in retaining the fastener against rotation during nut installation. In recent years, however, particularly with the advent of composite material substrates in aircraft, friction contributes minimally to bolt retention during nut installation, and this is especially true when the substrate opening is coated or lined with a sealant material having a typical low coefficient of friction. Accordingly, on some occasions, the fixture pin is the only structure preventing bolt rotation during nut installation. Torque loads between the power-driven nut and the bolt can sometimes be transmitted directly to the fixture pin, resulting in over-torqueing and breakage of the fixture pin. When this occurs, it has been necessary to remove the installation tool from service for appropriate repair or replacement.

The present invention provides a significant improvement upon fastener installation tools of the type having a fixture pin disposed coaxially within a power-driven socket, wherein the fixture pin is supported by a spring-loaded clutch assembly which permits fixture pin rotation without breakage in response to a torque load exceeding a predetermined limit. The fixture pin is thus protected against breakage during brief time intervals when torque loads applied thereto can be relatively high. In use, the clutch assembly effectively cooperates with the fixture pin to facilitate rapid power-driven nut installation while protecting the tool against breakage.

SUMMARY OF THE INVENTION

In accordance with the invention, an improved power-drive installation tool is provided for use with a threaded fastener of the type having a shallow recess in the shank end thereof for receiving a fixture pin which supports the fastener against rotation during power-drive installation of a threaded nut. The fixture pin is supported on a tool head by a spring -loaded clutch assembly for permitting fixture pin rotation in response to a torque load exceeding a predetermined limit. The clutch assembly thus protects the fixture pin against breakage in the event of high torque loads.

In the preferred form, the installation tool comprises an elongated fixture pin mounted coaxially within a rotatable socket associated with drive means for power-driven socket rotation. The fixture pin in longitudinally movable within said socket for retraction therein as the power-driven socket advances a threaded nut onto the threaded shank of a fastener, such as a bolt. The fixture pin is typically formed with an hexagonal cross section for seated reception into a mating recess in the shank end of the threaded fastener, to support said fastener against rotation during nut installation.

The clutch assembly comprises a cam wheel having a bore of noncircular cross sectional shape for longitudinal sliding reception of a matingly shaped land formed on the fixture pin. Accordingly, the fixture pin and cam wheel are rotatable together relative to the tool head. The cam wheel defines a plurality of radially outwardly protruding cam teeth or lobes which correspondingly define a plurality of radially outwardly open detent seats. A cam pin is mounted on the tool head and biased by a spring to urge a tip end thereof into one of the detent seats between an adjacent pair of the cam lobes. The spring-loaded cam pin thus normally prevents rotation of the cam wheel and the fixture pin therein, relative to the socket.

In use, application of a torque load to the fixture pin, during power-driven nut installation, is springably resisted by the cam pin engaged in the aligned one of the detent seats on the cam wheel. However, when the torque load exceeds a predetermined limit selected to be substantially less than a torque load sufficient to risk fixture pin breakage, the cam pin springably retracts to permit indexed-type rotation of the cam wheel and fixture pin therein. In use, the application of high torque loads to the fixture pin normally occurs at brief intervals, whereby such torque loads could result in cam wheel indexing through a small number of two or three detent seats prior to full installation of the nut.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
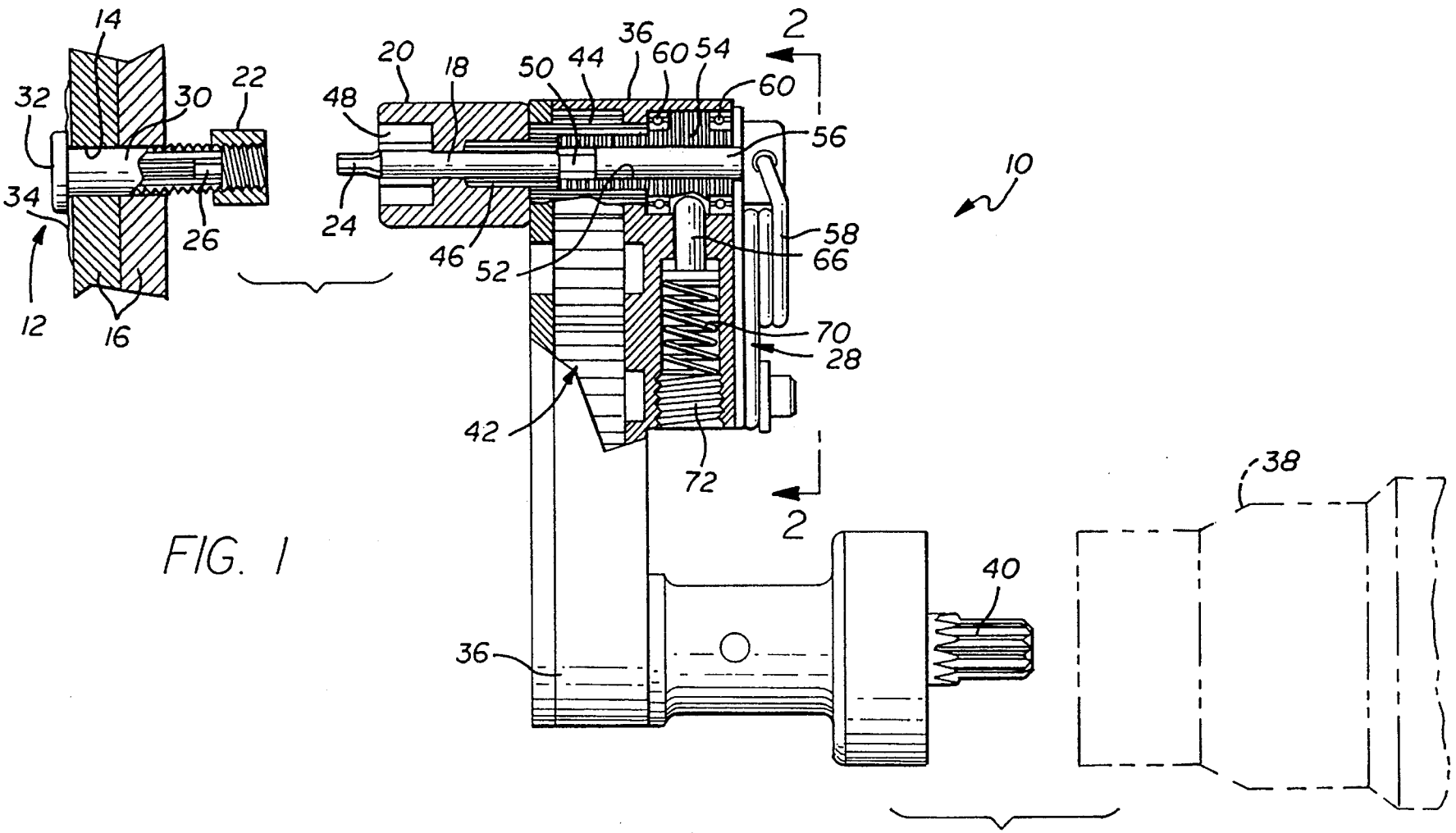
FIG. 1 is an exploded side elevational view, shown partially in vertical section, depicting the improved fastener installation tool of the present invention, for engaging and installing a threaded fastener.

As shown in the exemplary drawings, an improved installation tool referred to generally by the reference numeral 10 is provided for installing a threaded fastener 12 in a position extending through a port or opening 14 in a substrate 16. The installation tool includes a relatively small fixture pin 18 supported generally coaxially within a power-driven socket 20 for installing a threaded nut 22 onto the fastener 12. The fixture pin includes a leading or tip end 24 for seated reception within a matingly shaped recess 26 formed in the shank end of the fastener 12, to support the fastener 12 against rotation during power-driven installation of the threaded nut 22. In accordance with the invention, the installation tool 10 further includes a spring-loaded clutch assembly 28 for supporting the fixture pin 18 in a manner to prevent fixture pin breakage in the event of a high torque load applied thereto.

Figure 3:
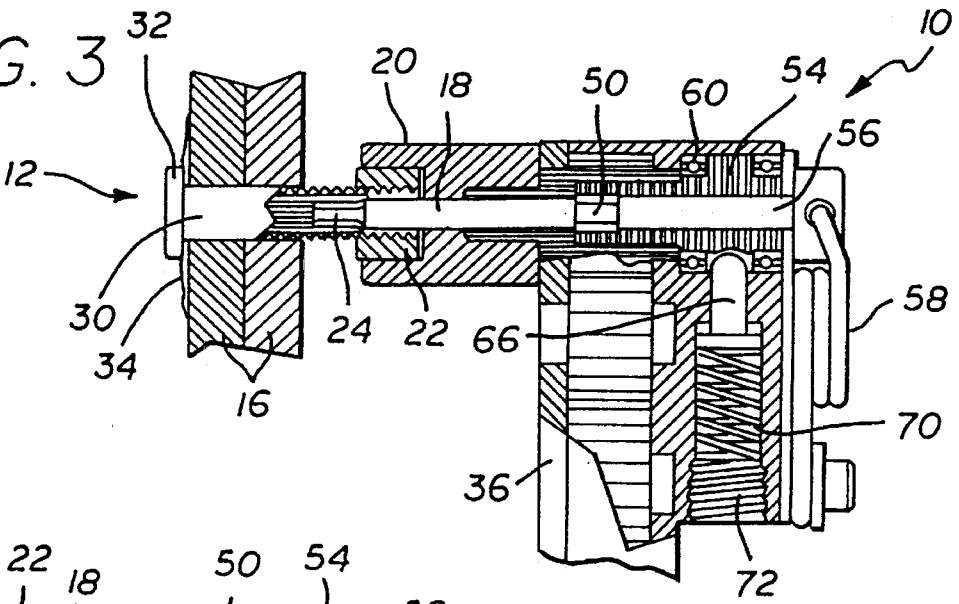
FIG. 3 is a fragmented sectional view similar to a portion of FIG. 1 and illustrating initial engagement of the installation tool with the threaded fastener.
Figure 4:
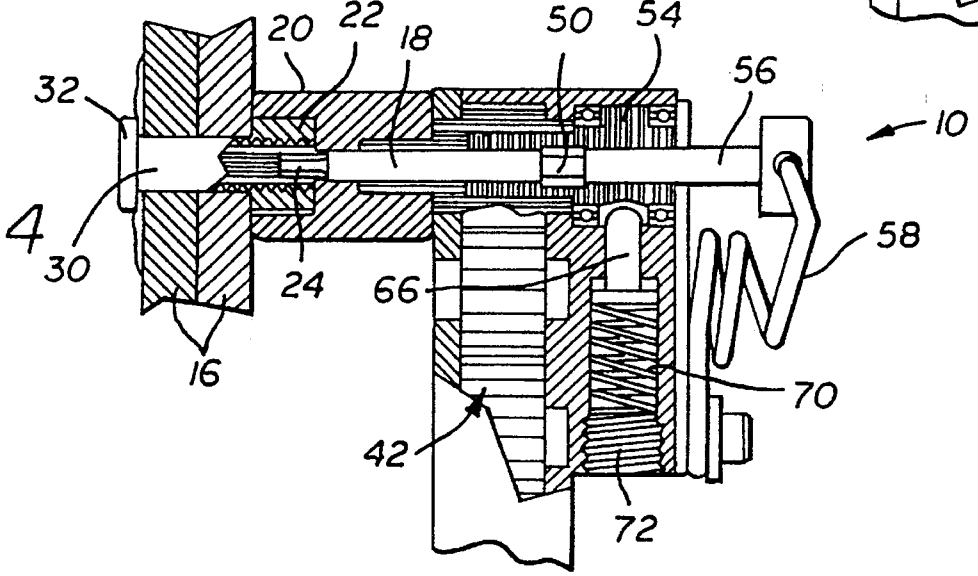
FIG. 4 is a fragmented sectional view similar to FIG. 3, and illustrating final installation of the threaded fastener.

The threaded fastener 12 represents a specialized fastener that is used extensively in aerospace and related industries, and the installation tool 10 of the present invention represents an improvement upon power-drive tools for installing such fasteners. More specifically, as shown in FIGS. 1, 3 and 4, the fastener 12 comprises an elongated bolt shank 30 joined at one end to an enlarged head 32. The shank 30 has a size and shape to fit through the substrate opening 14 which is normally preformed therein. A leading or tip end of the bolt shank 30 protrudes beyond a front surface of the substrate 16 and is externally threaded for thread-on installation of the nut 22. The recess 26 formed in the shank end of the fastener 12 has a noncircular cross sectional shape, typically an hexagonal shape, for mating reception of and engagement with the tip 24 of the fixture pin 18. In use, the fastener 12 is normally installed with the head 32 disposed on a blind or inaccessible side of the substrate 16. The fixture pin 18 on the installation tool 10 supports and retains the fastener 12 against rotation during thread-on installation of the nut 22. The nut 22 is engaged and driven by the power-drive socket 20 of the installation tool for advancing the nut onto the threaded shank 30, as shown sequentially in FIGS. 1, 3 and 4.

In some fastener applications, a sealant material 34 is used for sealing passage of the shank 30 through the substrate opening 14, wherein the presence of this sealant material 34 substantially reduces friction between the fastener and the adjacent substrate structure. As a result, minimal friction is present to assist the fixture pin 18 in retaining the fastener 12 against rotation during power-drive nut installation. This unfortunately contributes to occasional and typically brief intervals during which the driving torque of the socket 20 can be transferred to the fixture pin 18 via the nut 22 and fastener shank 30. In some cases, the torque loading of the fixture pin 18 can be sufficient to break the fixture pin. The clutch assembly 28 prevents such pin breakage by allowing the fixture pin 18 to rotate in response to torque loading in excess of a predetermined and relatively low torque limit.

Figure 5:
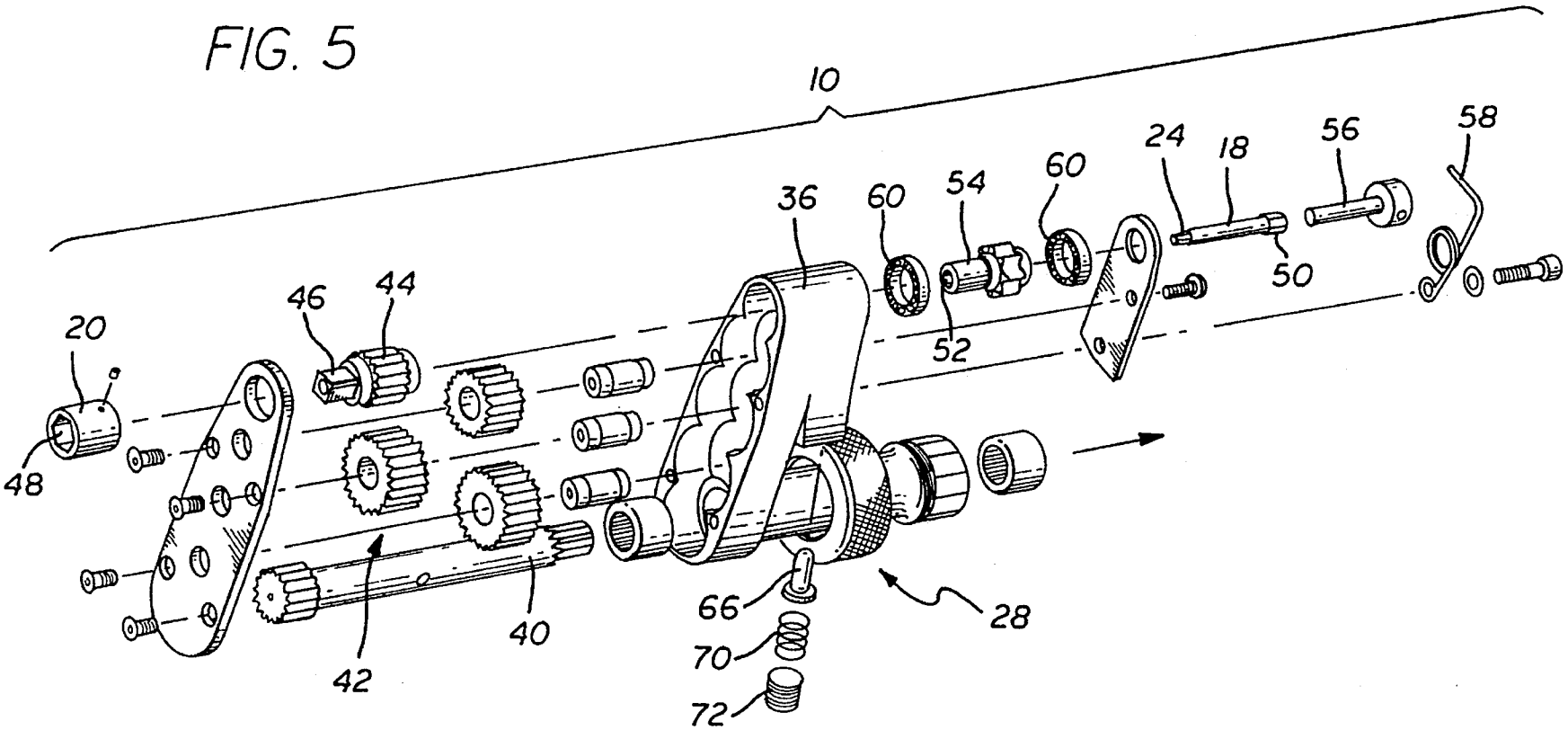
FIG. 5 is an exploded perspective view illustrating assembly details of the improved fastener installation tool of the present invention.

As shown generally in FIG. 1, the installation tool 10 comprises a relatively compact housing or head 36 adapted for mount-on quick-connect coupling to the drive end of a power tool 38, such as a rotary drive pneumatic tool of the type commonly used in manufacturing and maintenance facilities. A drive shaft 40 on the tool head is rotatably driven by the power tool 38, and this rotary drive motion is transmitted through a gear train 42 to a driven gear 44 (FIG. 5) connected by a square drive hub 46 or the like for power-drive rotation of the socket 20. The socket 20 in turn defines a seat 48 of noncircular, typically hexagonal cross sectional shape, for receiving and rotatably driving the threaded nut 22.

The fixture pin 18 is mounted within the tool head 36 in a position generally coaxially within the drive socket 20. The diametric size of the fixture pin 18 is sufficiently small to fit through the threaded nut 22, so as to avoid interference with power-drive installation of the nut onto the threaded fastener 12. The fixture pin 18 is carried within the tool head 36 for longitudinal sliding displacement, but is normally constrained against rotation by means of a land 50 of noncircular cross sectional shape, such as an hexagonal shape, located at the trailing end thereof. This land 50 is carried within a matingly shaped bore 52 of a cam wheel 54 forming a part of the clutch assembly 28, as will be described in more detail. Importantly, the pin land 50 and the bore 52 in the cam wheel 54 permit longitudinal displacement of the fixture pin 18.

A spring-loaded pin guide 56 is slidably mounted within a rear or aft end of the tool head 36, in axial alignment with the fixture pin 18. The pin guide 56 has a leading end in abutting engagement with the rear or trailing end of the fixture pin 18. A biasing spring 58 is coupled between the pin guide 56 and the tool head 36 to apply a forwardly directly biasing force to the fixture pin 18.

Figure 2:
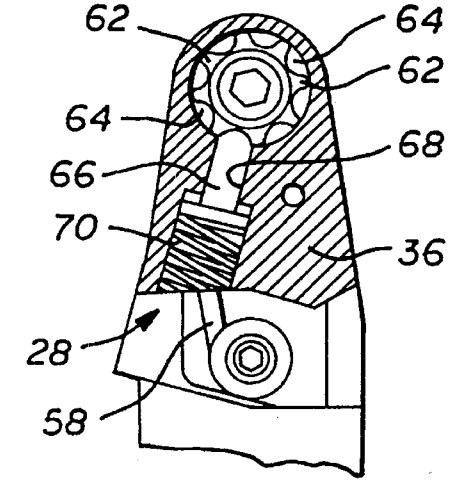
FIG. 2 is a fragmented rear elevational view of a portion of the fastener installation tool, shown partially in vertical section, taken generally along the line 2—2 of FIG. 1.

The cam wheel 54 is rotatably supported within the tool head 36 by suitable bearings 60 to accommodate rotation thereof on the fixture pin axis. The cam wheel defines a radially outwardly projecting plurality of teeth or lobes 62 (FIGS. 2 and 5) which in turn define a corresponding plurality of outwardly open detent seats 64. A cam pin 66 is slidably carried within a laterally projecting slot 68 formed in the tool head 36, and includes a smooth-surfaced or blunt tip end for reception into an aligned one of the detent seats 64 in the cam wheel 54. A spring 70 is interposed between a trailing end of the cam pin 66 and a set screw 72 on the tool head 36 for springably biasing the cam pin into engagement with the cam wheel 54. The force applied by the spring 70 can be variably adjusted, according to the thread-in or thread-out position of the set screw 72.

In operation, the installer typically starts rotation of the nut 22 onto the threaded shank 30 of the fastener 12. The tool 10 is then engaged with the nut 22 and fastener 12 for power-drive nut installation. As shown in FIG. 3, upon initial engagement, the tip 24 of the fixture pin 18 is received into the fastener recess 26, whereas the nut 22 is received into the socket 20. In this regard, the biasing spring 58 and related pin guide 56 normally position the fixture pin tip 24 to protrude axially beyond the nut 22 and socket 20.

When initial tool engagement is achieved, as viewed in FIG. 3, the power tool 38 is operated to rotatably drive the socket 20. This rotatably advances the nut onto the threaded shank 30. During this motion, the fixture pin 18 retains the fastener shank 30 against rotation relative to the substrate 16 or the socket 20. Nut advancement is accompanied by fixture pin retraction within the tool head, as shown in FIG. 4, until the nut 22 reaches the final installed position.

In the event that a high torque load is transferred through the nut and fastener to the fixture pin 18, during power-drive nut installation, the rotary torque applied to the fixture pin is transmitted to the cam wheel 54. When that torque exceeds a predetermined limit as defined by the spring force applied to the cam wheel 54 by the cam spring 70, the cam wheel 54 rotates in an indexing fashion, with the cam pin 66 springably retracting to permit cam wheel rotation followed by subsequent cam pin advancement for engagement into the next detent seat 64 in sequence. Accordingly, the clutch assembly 28 permits fixture pin rotation yet resists such rotation with a force proportional to the relative compression of the cam spring 70. In a typical installation sequence, when torque loads are encountered on the fixture pin 18, the cam wheel 54 may index through rotational increments corresponding to one to three detent seats 64, by the time final nut installation is achieved. Importantly, the torque load applied to the fixture pin 18 is limited, and risk of fixture pin breakage is substantially eliminated.

A variety of further modifications and improvements to the improved installation tool of the present invention will be apparent to those skilled in the art. Accordingly, no limitation on the invention is intended by way of the foregoing description and the accompanying drawings, except as set forth in the appended claims.

What is claimed is:

1. In a fastener installation tool having a socket for receiving and supporting a threaded nut, drive means for rotatably driving the socket for installing the nut onto a threaded fastener, and a fixture pin having a land of noncircular cross section formed therein and said fixture pin being disposed generally coaxially within the socket for engaging and supporting the threaded fastener against rotation during drive installation of the nut onto the fastener, the improvement comprising:

a clutch assembly for rotatably supporting the fixture pin within the socket to permit fixture pin rotation in response to a torque load applied to the fixture pin in excess of a predetermined limit, whereby said clutch assembly safeguards the fixture pin against breakage in response to a torque load applied thereto;

said clutch assembly comprising a cam wheel having a bore therein of noncircular cross section for mating and longitudinal sliding reception of said fixture pin, said cam wheel defining a plurality of radially outwardly open detent seats, a cam pin, and spring means for biasing said cam pin to a position with one end thereof seated within one of the detent seats in said cam wheel, said cam wheel being rotatable with said fixture pin in response to a torque load applied to the fixture pin in excess of the predetermined limit to cause said cam pin to retract against said spring means.

2. The fastener installation tool of claim 1 wherein said spring means springably resists fixture pin rotation, said spring means permitting fixture pin rotation in response to a torque load applied thereto in excess of said predetermined limit.

3. The fastener installation tool of claim 1 further including means for variably adjusting the spring force applied to said cam pin by said spring means.

4. The fastener installation tool of claim 3 wherein said cam pin is slidably carried within a slot within a tool housing, said spring force adjusting means comprising a set screw threadably mounted on said housing, said spring means comprising a compression spring reacting between said set screw and said cam pin.

5. The fastener installation tool of claim 1 wherein said fixture pin has a tip end of generally hexagonal cross section for engaging the fastener.

6. The fastener installation tool of claim 1 further including a spring-loaded pin guide for springably urging said fixture pin longitudinally in a direction toward the fastener, said fixture pin being longitudinally retractable within the socket and against said pin guide upon installation of the nut onto the fastener.

7. A fastener installation tool, comprising:

a tool head;

a socket mounted on said tool head for receiving and supporting a threaded nut;

drive means for rotatably driving said socket to install the nut onto a threaded fastener;

a fixture pin mounted on said tool head generally coaxially within said socket, said fixture pin having a tip end for engaging and retaining a threaded fastener to prevent rotation of a fastener during thread-on installation of a nut, said fixture pin having a land of noncircular cross section formed thereon; and a clutch assembly for rotatably supporting the fixture pin within the socket to permit fixture pin rotation in response to a torque load applied to the fixture pin in excess of a predetermined limit, whereby said clutch assembly safeguards the fixture pin against breakage in response to a torque load applied thereto;

said clutch assembly comprising a cam wheel having a bore therein of noncircular cross section for mating and longitudinal sliding reception of said fixture pin, said cam wheel defining a plurality of radially outwardly open detent seats, a cam pin, and spring means for biasing said cam pin to a position with one end thereof seated within one of the detent seats in said cam wheel, said cam wheel being rotatable with said fixture pin in response to a torque load applied to the fixture pin in excess of the predetermined limit to cause said cam pin to retract against said spring means.

8. The fastener installation tool of claim 7 wherein said spring means springably resists fixture pin rotation, said spring means permitting fixture pin rotation in response to a torque load applied thereto in excess of said predetermined limit.

9. The fastener installation tool of claim 7 further including a spring-loaded pin guide for springably urging said fixture pin longitudinally in a direction toward the fastener, said fixture pin being longitudinally retractable within the socket and against said pin guide upon installation of the nut onto the fastener.

10. The fastener installation tool of claim 7 further including means for variably adjusting the spring force applied to said cam pin by said spring means.

11. The fastener installation tool of claim 10 wherein said cam pin is slidably carried within a slot within said tool head, said spring force adjusting means comprising a set screw threadably mounted on said head, said spring means comprising a compression spring reacting between said set screw and said cam pin.

12. The fastener installation tool of claim 7 wherein said fixture pin tip end has a generally hexagonal cross section.

* * * * *